United States Patent [19]

Suzuki et al.

[11] Patent Number: 4,523,205

[45] Date of Patent: Jun. 11, 1985

[54] HEAT-SENSITIVE RECORDING MATERIALS

[75] Inventors: Toshitake Suzuki, Hyogo; Ryuzo Hayashi; Naoto Arai, both of Osaka; Yoshitaka Oeda, Nara, all of Japan

[73] Assignee: Kanzaki Paper Mfg. Co., Ltd., Tokyo, Japan

[21] Appl. No.: 552,919

[22] Filed: Nov. 18, 1983

[30] Foreign Application Priority Data

Nov. 30, 1982 [JP] Japan ..... 57-210057
Aug. 4, 1983 [JP] Japan ..... 58-144277

[51] Int. Cl.[3] ..... B41M 5/18

[52] U.S. Cl. ..... 346/208; 346/209; 346/221; 427/150; 427/151

[58] Field of Search ..... 346/208, 209, 221; 428/913; 427/150–153

[56] References Cited

U.S. PATENT DOCUMENTS 4,251,593 2/1981 Sakamoto et al. ..... 428/913
4,444,844 4/1984 Kubo et al. ..... 346/208

FOREIGN PATENT DOCUMENTS 53-5636 1/1978 Japan ..... 346/209
0057692 4/1982 Japan ..... 346/208
0064593 4/1982 Japan ..... 346/209
0087996 6/1982 Japan ..... 346/209

*Primary Examiner*—Bruce H. Hess
*Attorney, Agent, or Firm*—Finnegan, Henderson, Farabow, Garrett & Dunner

[57] ABSTRACT

A heat-sensitive material comprising a support having formed thereon a heat-sensitive recording layer, which has a high whiteness and is suitable for use in high-speed recording, is disclosed. The heat-sensitive recording layer comprises a colorless or pale-colored basic dye and a color developing material that, when heated, reacts with the basic dye to form a color, wherein the heat-sensitive recording layer further comprises at least one heat-fusible material having a melting point in the range of 70° C. to 140° C. and selected from the compounds represented by following formulae (I) to (VI):

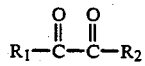
(I)

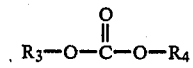
(II)

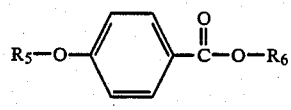
(III)

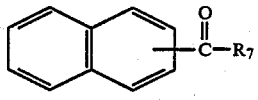
(IV)

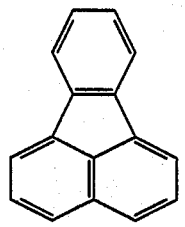
(V)

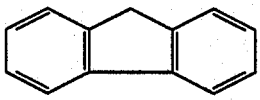
(VI)

wherein $R_1$, $R_2$, $R_5$, $R_6$, and $R_7$ independently represent a phenyl group, a benzyl group, or a tolyl group, each of which groups may be substituted with a halogen atom; and $R_3$ and $R_4$ independently represent an aryl group or an aralkyl group, each of which groups may be substituted with an alkyl group, an aralkyl group, a halogen atom, a hydroxy group, an alkoxy group, an aryloxy group, an alkylcarbonyloxy group, an arylcarbonyloxy group, an alkoxycarbonyl group, or an aryloxycarbonyl group.

5 Claims, No Drawings

HEAT-SENSITIVE RECORDING MATERIALS

FIELD OF THE INVENTION

This invention relates to a heat-sensitive recording material and more particularly, to a heat-sensitive recording material having high whiteness and an excellent property for high-speed recording.

BACKGROUND OF THE INVENTION

Hitherto, a heat-sensitive recording material which utilizes a coloring reaction of a colorless or pale-colored basic dye and a color developing material and provides a color image by contacting both coloring materials by the action of heat is well known as disclosed in, for example, U.S. Pat. No. 3,539,375. Recently, with the improvement of a heat-sensitive recording machine such as a heat-sensitive facsimile, a heat-sensitive printer, etc., using heat-sensitive recording materials, the recording speed of the heat-recording system is greatly increased. With the increase of the recording speed in these recording machines or hardware fields, heat-sensitive recording materials used for the purposes are, as a matter of course, required to greatly improve the recording sensitivity, and many attempts have been proposed in regarding to the recording sensitivity. However, since the improvement of the recording sensitivity encounters additional faults such as the reduction of whiteness of recording layer, etc., a satisfactory result is not always obtained. In such a circumstance, the inventors have made various investigations on improving the recording sensitivity of heat-sensitive recording materials without reducing the whiteness, etc.

In particular, various attempts have hitherto been made for improving the recording sensitivity by using a heat-fusible material together with a combination of a basic dye and a color developing material, and as the result of various investigations by greatly increasing the range of the investigation of the heat-fusible materials, the inventors have found that by using each of the compounds shown by general formulae (I) to (VI) as illustrated below, a very good effect of improving the recording sensitivity is obtained without reducing the whiteness as compared with the case of using a fatty acid amide, etc., such as stearic acid amide, palmitic acid amide, etc., and have succeeded in attaining this invention based on the discovery.

SUMMARY OF THE INVENTION

Thus, according to this invention, there is provided a heat-sensitive recording material comprising a support having formed thereon a heat-sensitive recording layer comprising a colorless or pale-colored basic dye and a color developing material that, when heated, reacts with the basic dye to form a color, wherein the heat-sensitive recording layer further comprises at least one heat-fusible material having a melting point in the range of 70° C. to 140° C., preferably 80° C. to 140° C. and selected from the compounds represented by following formulae (I) to (VI):

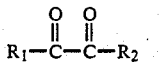

(I)

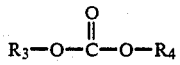

(II)

-continued

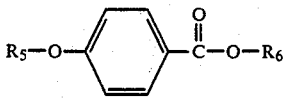

(III)

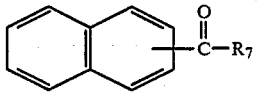

(IV)

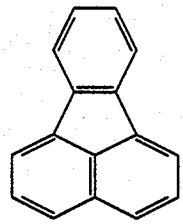

(V)

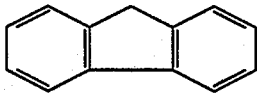

(VI)

wherein $R_1$, $R_2$, $R_5$, $R_6$, and $R_7$ independently represent a phenyl group, a benzyl group, or a tolyl group, each of which groups may be substituted with a halogen atom; and $R_3$ and $R_4$ independently represent an aryl group or an aralkyl group, each of which groups may be substituted with an alkyl group, an aralkyl group, a halogen atom, a hydroxy group, an alkoxy group, an aryloxy group, an alkylcarbonyloxy group, an arylcarbonyloxy group, an alkoxycarbonyl group, or an aryloxycarbonyl group.

DETAILED DESCRIPTION OF THE INVENTION

The reason that the foregoing specific heat-fusible material exhibits an effect of improving the recording sensitivity without reducing the whiteness has not yet been clarified, but it is considered to be one factor that the chemical structures of these compounds are similar to those of basic dyes and organic color developing materials, whereby the compatibility of the whole mixed system is increased.

Specific examples of the heat-fusible material which can be used in this invention are listed below.

| | |
|---|---|
| benzil | (m.p. 95° C.) |
| di-o-methylbenzil | (m.p. 93° C.) |
| di-m-methylbenzil | (m.p. 103° C.) |
| di-p-methylbenzil | (m.p. 104° C.) |
| benzyl phenyldiketone | (m.p. 90° C.) |
| 4-bromobenzil | (m.p. 89.5° C.) |
| diphenyl carbonate | (m.p. 80° C.) |
| di-p-tolyl carbonate | (m.p. 110° C.) |
| di-2,6-xylyl carbonate | (m.p. 121.5° C.) |
| di-2,5-xylyl carbonate | (m.p. 104° C.) |
| di-3,5-xylyl carbonate | (m.p. 117° C.) |
| di-3,4-xylyl carbonate | (m.p. 124° C.) |
| di-p-tert-butylphenyl carbonate | (m.p. 102.5° C.) |
| di-2,3,5-trimethylphenyl carbonate | (m.p. 112° C.) |
| di-3-chlorophenyl carbonate | (m.p. 121° C.) |
| 2,5-xylyl phenyl carbonate | (m.p. 71° C.) |
| p-tert-butylphenyl phenyl carbonate | (m.p. 73° C.) |
| 4-bromophenyl phenyl carbonate | (m.p. 101° C.) |

-continued

| | |
|---|---|
| p-methoxycarbonylphenyl phenyl carbonate | (m.p. 93° C.) |
| p-biphenylyl phenyl carbonate | (m.p. 136° C.) |
| α-naphthyl phenyl carbonate | (m.p. 95° C.) |
| β-naphthyl phenyl carbonate | (m.p. 132° C.) |
| phenyl phenethyl carbonate | (m.p. 89° C.) |
| phenyl p-phenoxybenzoate | (m.p. 78° C.) |
| phenyl β-naphthyl ketone | (m.p. 82° C.) |
| 2-bromophenyl α-naphthyl ketone | (m.p. 89° C.) |
| 2-chlorophenyl α-naphthyl ketone | (m.p. 82° C.) |
| 3-chlorophenyl α-naphthyl ketone | (m.p. 79° C.) |
| 4-chlorophenyl α-naphthyl ketone | (m.p. 126° C.) |
| benzyl α-naphthyl ketone | (m.p. 101° C.) |
| benzyl β-naphthyl ketone | (m.p. 100° C.) |
| m-tolyl α-naphthyl ketone | (m.p. 75° C.) |
| p-tolyl α-naphthyl ketone | (m.p. 85° C.) |
| fluoranthene | (m.p. 111° C.) |
| fluorene | (m.p. 115° C.) |

These heat-fusible materials may be used solely or as a mixture of them. Also, the heat-fusible material or materials may be further used together with a fatty acid amide such as stearic acid amide, stearic acid methylenebisamide, oleic acid amide, palmitic acid amide, a coconut fatty acid amide, etc., and further with various known heat-fusible materials, unless the desired effect of the invention is hindered. In addition, there is no particular restriction about the amount of the heat-fusible material having the foregoing specific structure, but it is preferred that the amount is generally 10 to 1,000 parts by weight, particularly, 50 to 500 parts by weight, per 100 parts by weight of the color developing material.

Colorless or pale-colored basic dyes which can be used in the preparation of the recording layer of the heat-sensitive recording material of the present invention include triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenyindole-3-yl)-6-dimethylaminophthalide, and 3-p-dimethylaminophenyl-3-(1-methylpyrrole-3-yl)-6-dimethylaminophthalide; diphenylmethane-based dyes, e.g., 4,4'-bis-dimethylaminobenzhydryl-benzylether, N-halophenylleucoauramine, and N-2,4,5-trichlorophenyl-leucoauramine; thiazine-based dyes, e.g., benzoyl-leucomethyleneblue, and p-nitrobenzoyl-leucomethyleneblue; spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiropyran, and 3-propylspiro-dibenzopyran; lactam-based dyes, e.g., rhodamine-B-anilinolactam, rhodamine(p-nitroanilino)lactam, and rhodamine(o-chloroanilino)lactam; and fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-diethylaminofluoran, 3-(N-ethyl-p-toluidino)-6-methyl-7-anilinofluoran, 3-(N-ethyl-p-toluidino)-6-methyl-7-(p-toluidino)fluoran, 3-diethylamino-6-methyl-7-anilinofluoran, 3-dibutylamino-6-methyl-7-anilinofluoran, 3-diethylamino-7-(2-carbomethoxyanilino)fluoran, 3-(N-cyclohexyl-N-methylamino)-6-methyl-7-anilinofluoran, 3-pyrrolidino-6-methyl-7-anilinofluoran, 3-piperidino-6-methyl-7-anilinofluoran, 3-diethylamino-6-methyl-7-xylidinofluoran, 3-diethylamino-7-(o-chloroanilino)fluoran, 3-dibutylamino-7-(o-chloroanilino)fluoran, and 3-pyrrolidino-6-methyl-7-p-butylanilinofluoran. The present invention is not limited to these exemplified basic dyes.

Furthermore, fluoran-based dyes shown by following general formula (VII) can be also effectively used in this invention;

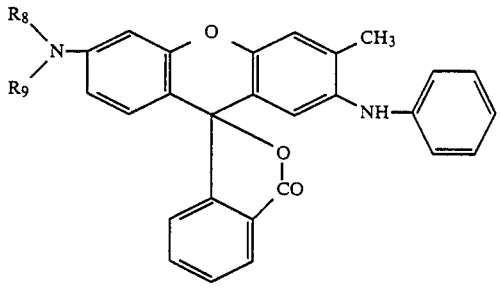

(VII)

wherein $R_8$ represents a methyl group or an ethyl group, and $R_9$ represents an alkyl group having 5 to 8 carbon atoms.

Specific examples thereof include 3-(N-methyl-N-n-amylamino)-6-methyl-7-anilinofluoran, 3-(N-ethyl-N-n-amylamino)-6-methyl-7-anilinofluoran, 3-(N-ethyl-N-isoamylamino)-6-methyl-7-anilinofluoran, 3-(N-methyl-N-n-hexylamino)-6-methyl-7-anilinofluoran, 3-(N-ethyl-N-n-hexylamino)-6-methyl-7-anilinofluoran, and 3-(N-ethyl-N-β-ethylhexylamino)-6-methyl-7-anilinofluoran. Since these dyes are excellent in compatibility with the foregoing specific heat-fusible materials used in this invention, more excellent effects can be expected in the point of high-speed recording aptitude. Also, these dyes have excellent features in the aptitude for both whiteness and recording sensitivity as described in Japanese Examined Patent Publication No. 52,759/'81, and since these properties are further improved by using together with the aforesaid specific heat-fusible materials, these dyes are particularly preferred in this invention.

There is no particular restriction about the color developing materials used together with the foregoing basic dyes in this invention, and various color developing materials having a property of causing liquefaction, vaporization, or dissolution by the increase of temperature and also having a property of coloring the foregoing basic dye by contacting therewith. Specific examples of the color developing material which can be used in this invention include phenolic compounds, e.g., 4-tert-butylphenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol, hydroquinone, 4,4'-cyclohexylidenediphenol, 4,4'-dihydroxydiphenyl sulfide, 4,4'-thiobis(6-tert-butyl-3-methylphenol), 4,4'-dihydroxydiphenylsulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak-type phenol resins, and phenolic polymers; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, and 3,5-di-α-methylbenzylsalicylic acid; and organic acidic materials, e.g., salts of these phenolic compounds or aromatic carboxylic acids and polyvalent metals (e.g., zinc, magnesium, aluminum, calcium, titanium, manganese, tin, nickel, etc.).

The ratio of the color developing material to the basic dye is generally 100 to 700 parts by weight, preferably 150 to 400 parts by weight, per 100 parts by weight of the basic dye. In addition, each of the basic dyes and color developing materials may be used as a mixture of two or more, if desired.

Water is generally used as a dispersion medium for preparing a heat-sensitive coating composition used for the formation of the recording layer of the present invention. The basic dye and color developing material of the present invention are in general separately dispersed in water by the use of an agitator or pulverizer such as a ball mill, attritor or sand mill, and the two dispersions are mixed into a coating composition which is then applied to a support. The heat-fusible material may be first dispersed in water and then mixed with the dispersions of the basic dye and color developing material. Alternatively, the heat-fusible material may be dispersed in water together with the basic dye or color developing material.

The coating composition usually contains a binder. Examples of such binders include starch, oxidized starch, esterified starch, etherified starch, other modified starches, hydroxyethyl cellulose, methyl cellulose, carboxymethyl cellulose, gelatin, casein, gum arabic, polyvinyl alcohol, styrene-maleic anhydride copolymer salts, styrene-acrylic acid copolymer salts, and styrene-butadiene copolymer emulsions. The amount of the binder used is generally 2 to 40% by weight, preferably 5 to 25% by weight, based on the weight of the total solids.

The coating composition may further contain various auxiliary agents. Examples of such auxiliary agents are dispersants such as sodium dioctylsulfosuccinate, sodium dodecylbenzenesulfonate, sodium lauryl sulfate and fatty acid metal salts; defoaming agents; fluorescent dyes; and coloring dyes.

Furthermore, in order that the heat-sensitive recording material does not produce sticking upon coming into contact with a recording head, dispersions or emulsions of stearic acid, polyethylene, carnauba wax, paraffin wax, zinc stearate, calcium stearate, and ester wax can be added to the coating composition. In order to reduce the attachment of tailings to a recording head, inorganic pigments such as kaolin, clay, talc, calcium carbonate, calcined clay, titanium oxide, activated clay, and oil-absorptive pigments (e.g., kieselguhr and fine granular anhydrous silica) can be added to the coating composition.

In the heat-sensitive recording material of this invention, there is no particular restriction about the manner of forming the recording layer, and conventional techniques can be used for forming the recording layer. For example, a proper coating device, such as an air knife coater, a blade coater, etc., can be used for coating a heat-sensitive coating composition on a support.

Also, although there is no particular restriction about the coating amount of the coating composition, it is usually 2 to 12 g/m$^2$, preferably 3 to 10 g/m$^2$, on a dry weight basis. In addition, there is also no particular restriction about the support used in this invention, and papers, synthetic fiber papers, synthetic resin films, etc. are properly used but papers are generally preferred.

Furthermore, for protecting the recording layer of the heat-sensitive recording material of this invention, an overcoat layer may be formed on the recording layer. On the other hand, it is as a matter of course possible to form a subbing layer on the support. That is, various known techniques in the field of heat-sensitive recording materials can be employed in this invention.

The heat-sensitive recording material of this invention thus obtained is excellent in high-speed recording property, has very high whiteness, and also has a very balanced property in quality.

The present invention is now described in greater detail by reference to the following Examples and Comparative Example which are given here for illustrative purposes only and are by no means intended to limit its scope. All parts and percentages are by weight.

EXAMPLE 1

Preparation of Solution A

| | parts |
|---|---|
| 3-(N—Cyclohexyl-N—methylamino)-6-methyl-7-anilinofluoran | 10 |
| Diphenyl carbonate (m.p. 80° C.) | 20 |
| 5% Aqueous solution of methyl cellulose | 15 |
| Water | 120 |

A composition made of the above ingredients was pulverized by means of a sand mill to an average particle size measured by a Coulter Counter (MODEL-TA, made by Coulter Electronics Inc.) of 3 μm. (This pulverization method is common in all of the Examples and Comparative Examples.)

Preparation of Solution B

| | parts |
|---|---|
| 4,4'-Isopropylidenephenol | 30 |
| 5% Aqueous solution of methyl cellulose | 30 |
| Water | 70 |

A composition made of the above ingredients was pulverized to an average particle size of 3 μm.

Formation of Recording Layer

A mixture of 165 parts of Solution A, 130 parts of Solution B, 30 parts of fine granular anhydrous silica [oil absorption (measured according to JIS K5101): 180 ml/100 g], 150 parts of a 20% aqueous solution of oxidized starch and 55 parts of water was stirred to prepare a coating composition. The coating composition was applied to a base paper of 50 g/m$^2$ in a dry weight of 7.5 g/m$^2$, and dried to prepare a sample of heat-sensitive recording paper.

EXAMPLE 2

By following the same procedure as in Example 1 except that fluorene (m.p. 115° C.) was used in place of the diphenyl carbonate in Solution A, a sample of heat-sensitive recording paper was prepared.

EXAMPLE 3

By following the same procedure as in Example 1 except that fluoranthene (m.p. 111° C.) was used in place of the diphenyl carbonate in Solution A, a sample of heat-sensitive recording paper was prepared.

EXAMPLE 4

By following the same procedure as in Example 1 except that di-2,5-xylyl carbonate (m.p. 104° C.) was used in place of the diphenyl carbonate in Solution A, a sample of heat-sensitive recording paper was prepared.

EXAMPLE 5

By following the same procedure as in Example 1 except that α-naphthyl phenyl carbonate (m.p. 95° C.) was used in place of the diphenyl carbonate in Solution A, a sample of heat-sensitive recording paper was prepared.

EXAMPLE 6

By following the same procedure as in Example 1 except that p-methoxycarbonylphenyl phenyl carbonate (m.p. 93° C.) was used in place of the diphenyl carbonate in Solution A, a sample of heat-sensitive recording paper was prepared.

EXAMPLE 7

By following the same procedure as in Example 1 except that di-p-tert-butylphenyl carbonate (m.p. 102.5° C.) was used in place of the diphenyl carbonate in Solution A, a sample of heat-sensitive recording paper was prepared.

EXAMPLE 8

By following the same procedure as in Example 1 except that di-p-tolyl carbonate (m.p. 110° C.) was used in place of the diphenyl carbonate in Solution A, a sample of heat-sensitive recording paper was prepared.

EXAMPLE 9

Preparation of Solution A

| | parts |
|---|---|
| 3-(N—Ethyl-N—isoamylamino)-6-methyl-7-anilinofluoran | 10 |
| Diphenyl carbonate | 20 |
| 5% Aqueous solution of methyl cellulose | 15 |
| Water | 120 |

A composition made of the above ingredients was pulverized to an average particle size of 3 μm.

Preparation of Solution B

| | parts |
|---|---|
| Benzyl 4-hydroxybenzoate | 30 |
| 5% Aqueous solution of methyl cellulose | 30 |
| Water | 70 |

A composition made of the above ingredients was pulverized to an average particle size of 3 μm.

Formation of Recording Layer

A mixture of 165 parts of Solution A, 130 parts of Solution B, 30 parts of fine granular anhydrous silica [oil absorption: 180 ml/100 g], 150 parts of a 20% aqueous solution of oxidized starch and 55 parts of water was stirred to prepare a coating composition. The coating composition was applied to a base paper of 50 g/m$^2$ in a dry weight of 7.5 g/m$^2$, and dried to prepare a sample of heat-sensitive recoding paper.

EXAMPLE 10

By following the same procedure as in Example 9 except that fluorene was used in place of the diphenyl carbonate in Solution A, a sample of heat-sensitive recording paper was prepared.

EXAMPLE 11

By following the same procedure as in Example 9 except that fluoranthene was used in place of the diphenyl carbonate in Solution A, a sample of heat-sensitive recording paper was prepared.

EXAMPLE 12

Preparation of Solution A

| | parts |
|---|---|
| 3-(N—Ethyl-N—isoamylamino)-6-methyl-7-anilinofluoran | 10 |
| Di-2,5-xylyl carbonate | 20 |
| 5% Aqueous solution of methyl cellulose | 15 |
| Water | 120 |

A composition made of the above ingredients was pulverized to an average particle size of 3 μm.

Preparation of Solution B

| | parts |
|---|---|
| 4,4'-Isopropylidenephenol | 30 |
| 5% Aqueous solution of methyl cellulose | 30 |
| Water | 70 |

A composition made of the above ingredients was pulverized to an average particle size of 3 μm.

Formation of Recording Layer

A mixture of 165 parts of Solution A, 130 parts of Solution B, 30 parts of fine granular anhydrous silica [oil absorption: 180 ml/100 g], 150 parts of a 20% aqueous solution of oxidized starch and 55 parts of water was stirred to prepare a coating composition. The coating composition was applied to a base paper of 50 g/m$^2$ in a dry weight of 7.5 g/m$^2$, and dried to prepare a sample of heat-sensitive recording paper.

EXAMPLE 13

By following the same procedure as in Example 12 except that α-naphthyl phenyl carbonate was used in place of di-2,5-xylyl carbonate in Solution A, a sample of heat-sensitive recording paper was prepared.

EXAMPLE 14

By following the same procedure as in Example 12 except that p-methoxycarbonylphenyl phenyl carbonate was used in place of the di-2,5-xylyl carbonate in Solution A, a sample of heat-sensitive recording paper was prepared.

EXAMPLE 15

By following the same procedure as in Example 12 except that di-p-tert-butylphenyl carbonate was used in place of the di-2,5-xylyl carbonate in Solution A, a sample of heat-sensitive recording paper was prepared.

EXAMPLE 16

By following the same procedure as in Example 12 except that di-p-tolyl carbonate was used in place of the di-2,5-xylyl carbonate in Solution A, a sample of heat-sensitive recording paper was prepared.

COMPARATIVE EXAMPLE 1

By following the same procedure as in Example 1 except that stearic acid amide was used in place of the diphenyl carbonate in Solution A, a sample of heat-sensitive recording paper was prepared.

COMPARATIVE EXAMPLE 2

By following the same procedure as in Example 12 except that stearic acid amide was used in place of the di-2,5-xylyl carbonate in Solution A, a sample of heat-sensitive recording paper was prepared.

Using the 18 samples of heat-sensitive recording paper prepared in Examples 1 to 16 and Comparative Examples 1 and 2, recording was conducted with a GIII type high-speed heat-sensitive facsimile apparatus (HIFAX 700 of Hitachi, Ltd.). The data on the recording sensitivity and the whiteness produced by the respective samples is given in the following table.

TABLE

| | Recording Sensitivity* | Whiteness** |
|---|---|---|
| Example 1 | 1.02 | 80.5 |
| Example 2 | 1.05 | 80.0 |
| Example 3 | 0.97 | 80.3 |
| Example 4 | 1.10 | 80.3 |
| Example 5 | 1.07 | 80.5 |
| Example 6 | 1.11 | 80.0 |
| Example 7 | 0.95 | 80.8 |
| Example 8 | 1.15 | 80.3 |
| Example 9 | 1.19 | 81.2 |
| Example 10 | 1.15 | 80.8 |
| Example 11 | 1.15 | 80.7 |
| Example 12 | 1.15 | 80.4 |
| Example 13 | 1.11 | 80.5 |
| Example 14 | 1.17 | 80.2 |
| Example 15 | 1.00 | 80.9 |
| Example 16 | 1.20 | 80.5 |
| Comparative Example 1 | 0.80 | 80.2 |
| Comparative Example 2 | 0.83 | 80.4 |

*The recording sensitivity is expressed by the color density of the recorded image, as measured with a Macbeth reflection densitometer (Model RD-100R; and amber filter was used), immediately after the recording on the facsimile apparatus. The higher the value, the better the property.

**The whiteness is expressed by the whiteness of recording layer, as measured with a Hunter multipurpose reflectometer, before the recording.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having formed thereon a heat-sensitive layer comprising a colorless or pale-colored basic dye and a color developing material that, when heated, reacts with the basic dye to form a color, wherein said heat-sensitive recording layer further comprises at least one heat-fusible material having a melting point in the range of 70° C. to 140° C. and selected from the compounds represented by following formulae (II), (IV), (V):

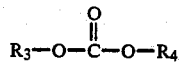
(II)

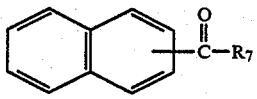
(IV)

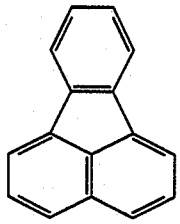
(V)

wherein $R_7$ independently represents a phenyl group, a benzyl group, or a tolyl group, each of which groups may be substituted with a halogen atom; and $R_3$ and $R_4$ independently represent an aryl group or an aralkyl group, each of which groups may be substituted with an alkyl group, an aralkyl group, a halogen atom, a hydroxy group, an alkoxy group, an aryloxy group, an alkylcarbonyloxy group, an arylcarbonyloxy group, an alkoxycarbonyl group, or an aryloxycarbonyl group.

2. A heat-sensitive recording material as claimed in claim 1, wherein said heat-fusible material is a compound represented by following formula (II):

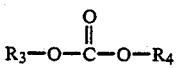
(II)

wherein $R_3$ and $R_4$ are the same as defined in claim 1.

3. A heat-sensitive recording material as claimed in claim 1, wherein said heat-fusible material is a compound represented by following formula (IV):

(IV)

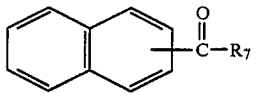

wherein $R_7$ is the same as defined in claim 1.

4. A heat-sensitive recording material as claimed in claim 1, wherein said heat-fusible material is a compound represented by following formula (V):

(V)

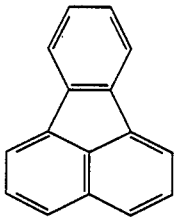

5. A heat-sensitive recording material as claimed in claim 1, wherein said basic dye is a dye represented by following formula (VII):

(VII)

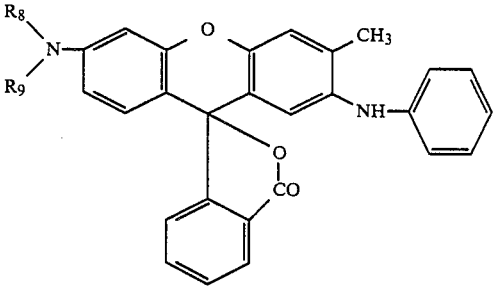

wherein $R_8$ represents a methyl group or an ethyl group, and $R_9$ represents an alkyl group having 5 to 8 carbon atoms.

* * * * *